US005511837A

United States Patent [19]

Dempsey et al.

[11] Patent Number: 5,511,837

[45] Date of Patent: Apr. 30, 1996

[54] DOOR BLOCK FOR EMERGENCY USE

[75] Inventors: Edward T. Dempsey, Midlothian; Kenneth B. Cooley, Jr.; Kenneth E. Batty, both of St. Joseph, all of Ill.

[73] Assignee: E. T. Dempsey Company Inc., Midlothian, Ill.

[21] Appl. No.: 442,683

[22] Filed: May 17, 1995

[51] Int. Cl.[6] ..... E05C 19/18

[52] U.S. Cl. ..... 292/288; 292/343; 292/DIG. 17; 16/82; 16/319

[58] Field of Search ..... 292/288, 343, 292/DIG. 17, DIG. 19; 16/319, 82, 374

[56] References Cited

U.S. PATENT DOCUMENTS

| | | | |
|---|---|---|---|
| 83,967 | 11/1868 | Howell | 292/288 |
| 1,354,046 | 9/1920 | Lanning | 292/343 |
| 4,831,688 | 5/1989 | Deininger | 16/319 |
| 5,027,471 | 7/1991 | Barnes | 16/86 R |
| 5,044,681 | 9/1991 | Neighbors | 292/288 |

FOREIGN PATENT DOCUMENTS

| | | | |
|---|---|---|---|
| 2677398 | 12/1992 | France | 292/288 |
| 323152 | 12/1934 | Italy | 16/374 |
| 130366 | 2/1929 | Switzerland | 292/288 |
| 162091 | 8/1933 | Switzerland | 292/288 |

*Primary Examiner*—Rodney M. Lindsey
*Attorney, Agent, or Firm*—Don Moyer

[57] ABSTRACT

A block generally in the form of a right, isosceles triangular prism has a hook attached to the block to extend beyond the apex of the prism so that the hook can be hung over a door hinge leaf next to the hinge barrel on the right or left side to brace the door open, the hook being attached to the block so that the hook can be retracted into the block when the door block is not in use.

6 Claims, 1 Drawing Sheet

DOOR BLOCK FOR EMERGENCY USE

BACKGROUND OF THE INVENTION

This invention relates to devices which block doors from closing and relates to the use of these devices by emergency workers in emergencies.

Emergency workers, such as fire fighters, need to block doors in an open position as they move into an emergency situation. Wedges which can be placed under doors have to be very large to accommodate the range of spaces between the floor and door bottoms which would normally be encountered. Wedges lodged in the space where the door is hinged are unreliable. When the door is bumped by a fire hose the wedge will be dislodged and the door will swing closed over the hose, creating a very dangerous situation. Fire fighters often are forced to give up valuable equipment—such as their ax, or oxygen tanks—to block doors open.

The art has been progressed by several proposals. A training video for fire fighters shows the use of a "homemade" piece of angle iron with a substantial hook attached to its vertex. The device is used by placing the hook over a door hinge leaf just next to the hinge barrel. The size of the hook limits the range of doors which this device will block. The bulk of this homemade device limits the number of these devices which emergency workers can carry easily. The edges will tear the pockets in which emergency will carry this device. And, the exposed hook will cause time wasting tangles when several of these homemade door blocks are carried together.

The device proposed by Deininger in U.S. Pat. No. 4,831,688 is intended to fit over the top of a door hinge barrel. Since there is a wide range of diameters of door hinge barrels, if this device is large enough to fit over the largest diameter door hinge barrel which an emergency worker is likely to encounter, then the device will poorly fit the smallest diameter door hinge barrel which an emergency worker is likely to encounter and will be dislodged easily from the small barrel. Also, this device will have to be made of heavy material in order to be reliable.

The device proposed by Barnes in U.S. Pat. No. 5,027,471 provides for a solid block to be hung over a door hinge barrel, and the device proposed by Neighbors in U.S. Pat. No. 5,044,681 provides for a more flexible space frame to be hung over a door hinge barrel. Again, for both these devices the range of diameters of door hinge barrels which will normally be encountered will jeopardize the reliability. These, and all the other prior, devices would be difficult to carry because of their shape. Emergency workers are likely to carry this type of device in a jacket or pants pocket where all of these prior devices would cause damage and get entangled.

Thus, there are opportunities to progress the art further by devising a door block which will be more reliable, in that it can be used to block a wider range of doors, and by devising a door block which can be carried more easily by emergency workers and can be used more easily in emergencies.

SUMMARY OF THE INVENTION

Objects of this invention include the following. Make a door block so that several can be carried easily by emergency workers. Make a door block which can be used easily and reliably in emergencies, even when there is limited or zero visibility. Make a door block which can be used easily and reliably on the widest range of doors. Make a door block which can be manufactured and marketed easily.

In summary, one embodiment of this door block for emergency use is made of a block which has a hook attached to the block to extend beyond the block so that the hook can be hung over a door hinge leaf next to the hinge barrel on the right or left side to brace the door open, the hook being attached to the block so that the hook can be retracted into the block when the door block is not in use.

Other embodiments will be comprehended in the detailed description, which will make additional embodiments obvious to those skilled in the relevant art.

DRAWING FIGURES

DETAILED DESCRIPTION OF THE INVENTION

Figure 1:
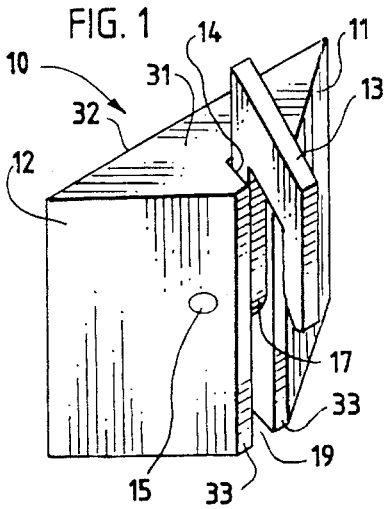
FIG. 1 shows the door block with the hook extended
Figure 2:
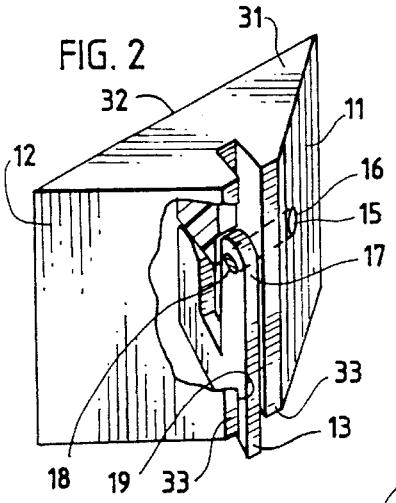
FIG. 2 shows the door block with the hook retracted
Figure 3:
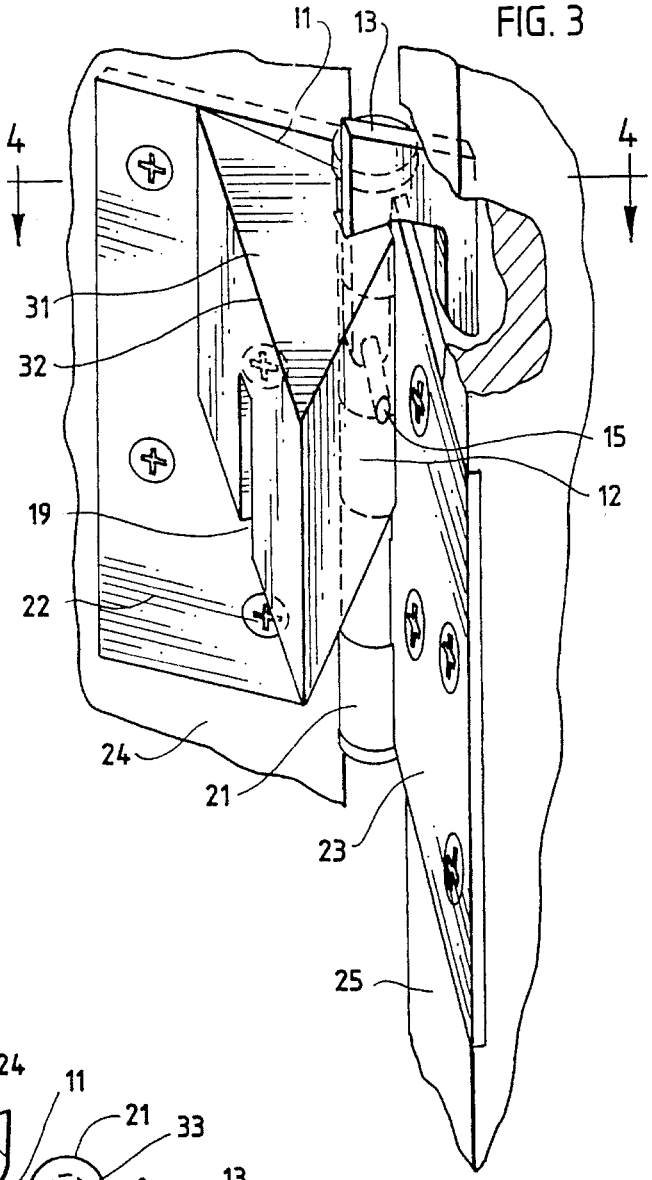
FIG. 3 shows the door block in use on a door hinge
Figure 4:
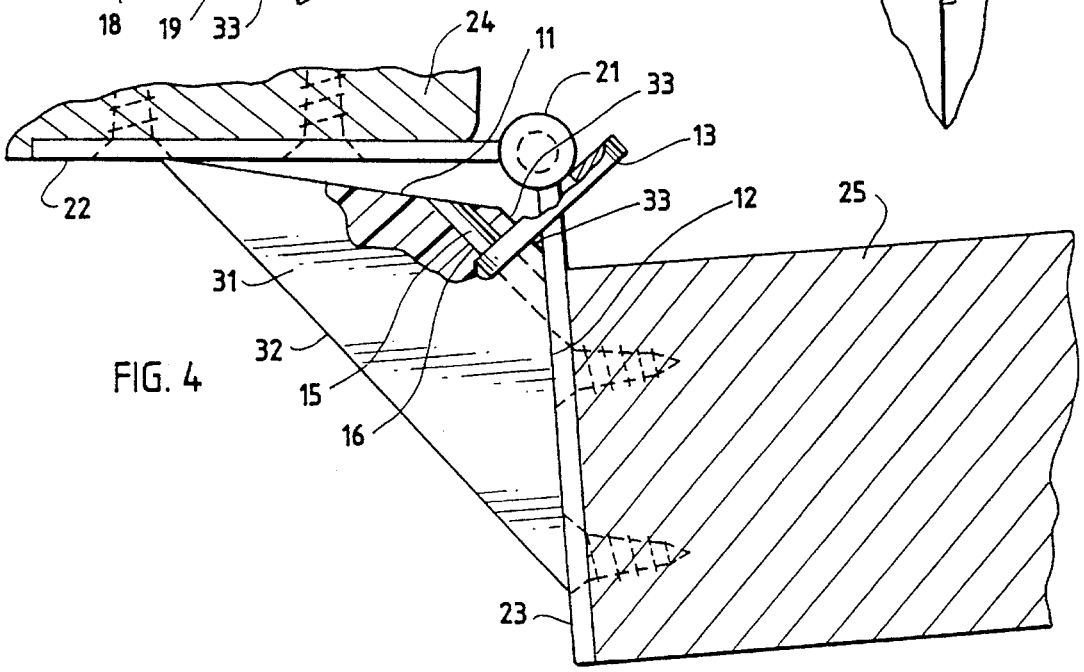
FIG. 4 is a partial cross section taken on the line 4—4 in FIG. 3 showing the hook in use on a door hinge.

FIG. 1 shows the door block 10 with the hook 13 open so that the door block can be used as shown in FIG. 3 and FIG. 4. FIG. 2 shows the door block with the hook 13 retracted into the slot 14 so that the door block can be stowed and carried easily.

In use, the hook 13 is hung over either leaf of a door hinge just next to the door hinge barrel 21. FIG. 3 and FIG. 4 show the hook 13 hung over the right leaf 23. The hook can be hung over either leaf so that the door block can accommodate variations in door hanging which may leave more space between the hinge barrel 21 and the door 25 or between the hinge barrel and the door frame 24. In either method of use, the block left side 11 encounters the door hinge left leaf 22 and the block right side 12 encounters the door hinge right leaf 23. The interior angle between the block left side and the block right side is one hundred ten degrees in the preferred embodiment. FIG. 4 shows how this allows the door block to brace the door 25 open ninety degrees from the door frame 24. The angle at which any door can be braced open by this door block will depend on the size of the door hinge barrel and will depend upon the actual placement of the door block but will not vary much away from ninety degrees.

Many equivalent shapes will provide the required function. The only requirement is that the block encounter both leafs of the hinge—or equivalently encounter both the door and the door frame—and that the block be rigid enough to hold the door open. Also, many forms of hook and many equivalent ways to retract the hook will provide the required function of hanging the block between the door and the door frame while in use and allowing the door block to be stowed and carried easily while not in use.

In the preferred embodiment, the block is generally in the form of a right, isosceles triangular prism, with the block top 31 being a right section of the prism. The back edge 32 of the block is the base of the isosceles triangle. The altitude of the isosceles triangle is the perpendicular distance from the triangle base to the triangle apex formed by the intersection of the lines extending the equal sides of the triangle past the block front surface 33, which can best be seen in FIG. 4. Because the apex of the triangle is located beyond the front surface 33 of the block, the interior angle between the block left side and the block right side can be closely congruent with the opening angle between the hinge left leaf and the hinge right leaf when the block is hung over a door hinge. The advantage of this can be understood from FIG. 4 where it can be seen that the door block can be used with a very wide range of sizes of hinge barrels and a very wide range of spaces between the hinge barrel and the door or door frame.

In the preferred embodiment, the hook 13 is fiat so that it takes minimal space between the hinge barrel and the door or door frame and so that it is strong enough to not be dislodged by the door closing forces which normally might be encountered. In use, the hook shank 17 is contained in the slot 14. The slot 14 extends into the block along the triangle altitude. The hook is attached to the block by a pin 15 which passes through the block parallel to the block back edge 32 and which passes through a hole in the hook shank. Below the pin, the slot lower portion 19 extends fully through the block so that the hook 13 can be rotated about the pin to be fully retracted into the block, as is shown in FIG. 2.

FIG. 3 shows that in the preferred embodiment the hook has a top surface which slants down away from the hook shank 16, and FIG. 2 shows that because of this slant feature when the hook is retracted into the block, a portion of the hook protrudes out of the slot lower portion 19. FIG. 3 also shows that the bill of the hook is curved so that the hook is easily guided into the hanging position shown in FIG. 3. The slant feature is used to make it easy to push the hook into the opened position and is used to make it easy to hold the hook in the opened position while the door block is being hung over a door hinge leaf. The block can be held in one hand and the hook can be rotated into open position by rubbing the door block across any surface, such as a fire fighter's coat. The door block can then be held easily in one hand with a finger pressing on the slanted top surface to hold the hook in the opened position. All of this can be done by feel in situations where visibility is low or zero.

In the preferred embodiment, with the hook 13 retracted into the block, the door block measures about two and one half inches along the back edge 32, about three quarters of an inch along the triangle altitude from the back edge to the front surface, and about two inches along the remaining dimension perpendicular to the back edge. Several of these door blocks can be carried easily in a pocket without getting entangled and without causing damage. In the preferred embodiment the block is manufactured from recycled polyethylene, the hook stamped from eleven gauge steel sheet stock, and the pin is cut from one eighth inch steel rod stock.

Other equivalent forms for the door block, such as quadrangular prisms, or cylinders, or other space frames, and other equivalent means for attaching the hook so that the hook can be retracted, such as sliding the hook clown into an appropriate slot or swinging the hook aside into a recess, will be obvious to people skilled in the art. It is understood therefore that this invention is not limited to the particular embodiments disclosed here.

We claim:

1. A door block comprising:

a block which can be attached to a door hinge, the hinge having a right leaf and a left leaf, the right leaf and the left leaf being joined by a hinge barrel, the block having a right side which can contact the hinge right leaf and the block having a left side which can contact the hinge left leaf, the block having a distance and a rigidity between the block right side and the block left side sufficient to prevent the door from swinging closed thus bracing the door in open position; and a hook attached to the block, the hook being disposed so that the hook can removably hang over the hinge left leaf just next to the hinge barrel to hold the block between the hinge right leaf and the hinge left leaf, and so that the hook can removably hang over the hinge right leaf just next to the hinge barrel to hold the block between the hinge left leaf and the hinge right leaf, the hook being attached to the block so that the hook can be retracted into the block when the door block is not in use.

2. The door block of claim 1 wherein the block is generally in the form of a right, isosceles triangular prism, the prism having a top which is an isosceles triangle, and the prism having a back edge which is the isosceles triangle base.

3. The door block of claim 2 wherein the hook has a shank which is movably attached to the block in a slot in the block, the slot extending into the block along the triangle's altitude so that the hook can be retracted into the block.

4. The door block of claim 3 wherein the hook shank is movably attached to the block by a pin, the pin passing through a hole in the hook shank, and the pin being set in a block hole, the block hole being generally parallel to the block back edge between the block left side and the block right side.

5. The door block of claim 4 wherein the hook has a top surface which slants downward away from the hook shank.

6. The door block of claim 5 wherein a portion of the hook protrudes from the slot when the hook is retracted into the block.

* * * * *